US005536005A

United States Patent [19]

Koff

[11] Patent Number: 5,536,005

[45] Date of Patent: Jul. 16, 1996

[54] MEANS FOR RACKET TO RETURN STRINGS TO ORIGINAL POSITION AFTER BALL IMPACT

[76] Inventor: Steven G. Koff, 7 Peabody Ter., Unit 21, Cambridge, Mass. 02138

[21] Appl. No.: 226,432

[22] Filed: Apr. 12, 1994

Related U.S. Application Data

[63] Continuation of Ser. No. 28,391, Mar. 9, 1993, abandoned.

[51] Int. Cl.[6] ..... A63B 51/02

[52] U.S. Cl. ..... 273/73 R

[58] Field of Search ..... 273/73 R, 73 A, 273/73 B, 73 D; 57/232

[56] References Cited

U.S. PATENT DOCUMENTS

| | | | |
|---|---|---|---|
| 2,100,250 | 11/1937 | Heyl | 149/1 |
| 2,307,470 | 1/1943 | Salathe, Jr. | 117/141 |
| 4,005,863 | 2/1977 | Henry | 273/73 D |
| 4,238,262 | 12/1980 | Fishel | 156/166 |
| 4,377,288 | 3/1983 | Sulprizio | 273/73 D |
| 4,377,620 | 3/1983 | Alexander | 428/372 |
| 4,462,591 | 7/1984 | Kenworthy | 273/73 D |
| 4,586,708 | 5/1986 | Smith et al. | 273/73 D |
| 4,597,576 | 7/1986 | Haythornthwaite | 273/73 D |

FOREIGN PATENT DOCUMENTS

| | | | |
|---|---|---|---|
| 3447608A1 | 7/1986 | Germany . | |
| 60-77776 | 5/1985 | Japan . | |
| 61-103457 | 5/1986 | Japan . | |
| 2144080 | 6/1990 | Japan | 273/73 R |
| 4-30867 | 2/1992 | Japan | 273/73 R |
| 2126614 | 3/1984 | United Kingdom . | |

*Primary Examiner*—William E. Stoll

[57] ABSTRACT

A racquet string is provided that integrates a non-circular string substrate with a solid lubricant. The combination of lubrication with an elongated shape allows woven racquet strings to be easily displaced while striking a ball, yet able to rebound quickly to their originally strung positions. These features improve spin control, reduce racquet vibration, improve ball rebound consistency, and lengthen string life.

10 Claims, 3 Drawing Sheets

MEANS FOR RACKET TO RETURN STRINGS TO ORIGINAL POSITION AFTER BALL IMPACT

This application is a continuation of Ser. No. 28,391 filed Mar. 9, 1993, now abandoned.

FIELD OF THE INVENTION

The invention relates to a string for a racquet, and more particularly to an elongated, low friction string that enhances string sliding and durability, reduces racquet vibrations, and improves ball control.

BACKGROUND OF THE INVENTION

Racquets 10 for sports such as tennis, racquetball, and squash typically comprise a handle 12 connected to a head or frame 14 strung with cylindrical nylon or gut strings 16, as shown in FIG. 1. The strings are threaded through openings in the frame 14 and woven to make a grid-like pattern that serves as a ball striking surface. The grid pattern of the weave is created by alternating horizontal and vertical strings, 18 and 20, respectively, in an over and under manner, as shown in FIG. 2, which is a sectional view of FIG. 1 taken along the line A–A'. The woven strings 16 are placed under tension, within the material limits of the frame 14 and strings 16, to provide the rebound and control characteristics of the striking surface desired by the racquet sport athlete. The texture of the weave is related to the shape of the individual strings 16 and the distortion each causes the overlapping string to undergo. The angle of distortion for overlapping circular strings 16 is depicted as Θ in FIG. 2.

The string tension, and the rebound and control characteristics influenced thereby, produce a variety of collateral effects during play that are related to string displacement, racquet vibration, and string durability. For example, when a player imparts a spin to a ball, the positioning and movement of the racquet 10 causes a lateral or cross force to be applied to the strings 16 that contact the ball. However, the strings 16 only shift laterally relative to the racquet frame 14 if the sum of the static friction forces at the intersections or junctions 22 between the vertical and horizontal strings, 20 and 18, respectively, is lower than the lateral force imparted by contact with the ball. Thus, to cause the strings to slide, the ball must be hit hard enough to overcome static friction forces. The greatest spin can be imparted to a ball when the strings do not slide at all. However, if the strings are displaced and then return to their pre-displacement position, a greater amount of spin is induced than if the strings are displaced and remain displaced.

With respect to spin control, the ideal string 16 would be under normal tensile loading, yet be easily displaced upon contact with the ball and then quickly rebound to its normal position prior to displacement. This, however, is not how the strings 16 in prior art racquets 10 are configured or behave.

Prior art strings 16, such as those described in U.S. Pat. Nos. 4,005,863 to Henry and 4,377,288 to Sulprizio teach inhibition of string displacement or sliding by providing non-circular strings with angular edges that increase friction at string crossing junctions. Because these strings, as well as more conventional circular strings, do not slide easily once displaced from an initial equidistant string spacing during play, they tend to maintain their irregular spacing until manually relocated by a player during a pause in the action. Until realigned, the irregular weave density causes unpredictable ball rebound.

When the strings 16 are moved by contact with a ball, the string movement transmits less lateral force into the frame 14 of the racquet 10. If the vertical strings 20 do not slide, the entire lateral load is carried by a lateral deflection of the racquet frame 14 followed by frame oscillations or vibrations which are felt in the racquet handle 12. Racquet vibrations thus transmitted to a player's hand and arm can be distracting and fatiguing, and over a prolonged period, excessive vibration can aggravate a condition of "tennis elbow." Unacceptable vibration can be countered by having the racquet 10 strung at a lower tension, because looser strings 16 provide a greater cushion for the ball load. But, as discussed hereinabove, a reduction in string tension exacts a rebound and control penalty.

If a player opts for normal (high) string tension in a conventionally strung racquet 10, rapid string wear results in addition to vibration and control problems. Conventional strings 16 develop notches 24 in the strings 16 as shown in FIG. 3, from wear caused by high string tension in the woven string pattern, ball contact increasing the normal force at the string junctions 22, and lateral movement of the vertical strings 20 caused by lateral forces imparted to the ball. The tensile load carried by the strings 16 is channeled to the reduced cross-sectional string area in the vicinity of the notches 24. These stress concentrations significantly increase string elongation in these areas and shorten the life of the strings 16. Most often, string failure occurs in the vicinity of the notches 24 in the vertical strings 20. This is particularly problematic in newer tennis racquets that have a larger contact surface than in previous racquet configurations. The resultant greater expanse of string 16 necessitates higher string tension which in turn reduces string durability.

In order to ameliorate the string wear problem caused by high tension and exacerbated by ball impact, prior art devices have focused on alteration of string shape to enlarge the contact area or junction between crossed strings in order to reduce wear. For example, U.S. Pat. No. 4,597,576 to Haythornwaite, teaches non-circular cross-section strings that are held more firmly in place by virtue of their shape, to prolong string life by reducing wear due to sliding. Japanese Patent Document No. 60-77776 discloses gut made from synthetic resin that also has a non-circular cross-section. The larger contact area at the string junctions created by the enlarged cross-section reduces string breakage due to tension and increases contact friction to prevent breakage due to hitting impact. German Patent Document No. 3447608 teaches natural gut or plastic strings having an oval or rectangular cross-section, wherein the non-traditional shape increases the contact area between crossed strings so as to reduce high spot friction due to ball impact. While these devices address the problem of string wear, they teach immobilization of the string to maintain the strings in a static relationship and do not consider vibration problems.

Another technique for prolonging string life is the application of a coating, such as a lubricant, to the strings. For example, U.S. Pat. No. 4,377,620 to Alexander, teaches gut that comprises a gut body coated with a film of minute particles of ethylene tetrafluoride resin either in a solvent or a molten resin. The coated gut protects the gut from damage at the time of stretching the gut on the racquet and from wear during use. U.S. Pat. No. 2,307,470 to Slathe, Jr., teaches a gut string coated with a thin nylon layer to improve wear resistance. Neither Alexander nor Slathe, Jr., however, teach coating a non-circular string, nor do they seek to encourage string sliding or teach a structure for reducing racquet vibration.

In summary, none of the prior art discloses or suggests advantages or motivations for combining non-circular strings with a lubricated string to reduce string wear. Furthermore, the prior art does not disclose or suggest how string shape and coating can be configured for improving spin control and reducing vibration without reducing string tension.

SUMMARY OF THE INVENTION

An improved racquet string is provided that has a non-circular cross-section and low friction properties to facilitate string-on-string sliding. In a first embodiment, a non-circular racquet string is treated with a friction reducing material. The string includes either a nylon matrix with a solid lubricant dispersed therethrough, a solid lubricant coating on a nylon substrate, or a solid lubricant coating on a nylon matrix with a solid lubricant dispersed therethrough. The solid lubricant can be polytetrafluorethylene (Teflon®), molybdenum disulfide, graphite, or a combination of the three. The cross-sectional shape of the strings can be elliptical, oval, "racetrack," flat or any other non-circular shape.

In a second embodiment, a tennis racquet is provided with noncircular strings treated with a friction reducing material. Main and cross strings are disposed within the racquet in a woven pattern. The friction reducing material, in combination with the non-circular string shape, causes the strings to return to their original positions when displaced, attenuates vibration, increases ball spin, and reduces frictional wear.

BRIEF DESCRIPTION OF THE DRAWINGS

These and further features of the invention may be better understood with reference to the accompanying specification and the drawings in which.

DETAILED DESCRIPTION OF THE INVENTION

Figure 1:
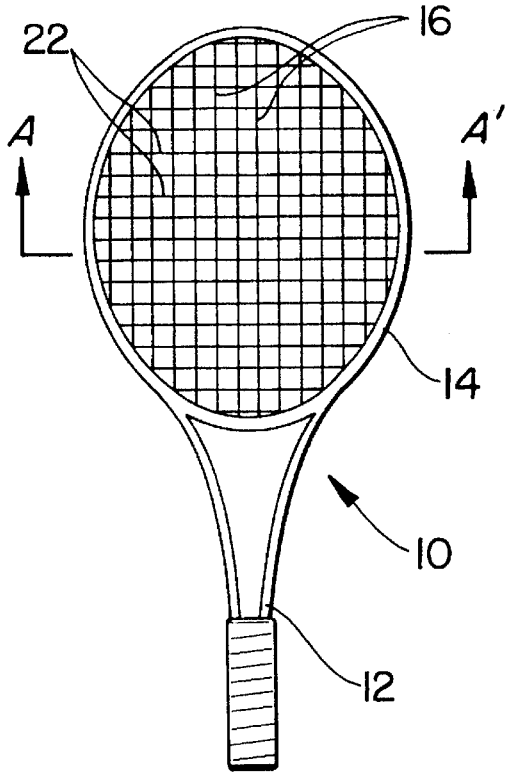
FIG. 1 (PRIOR ART)
FIG. 1 is a plan view of a tennis racquet with conventional strings.
Figure 4:
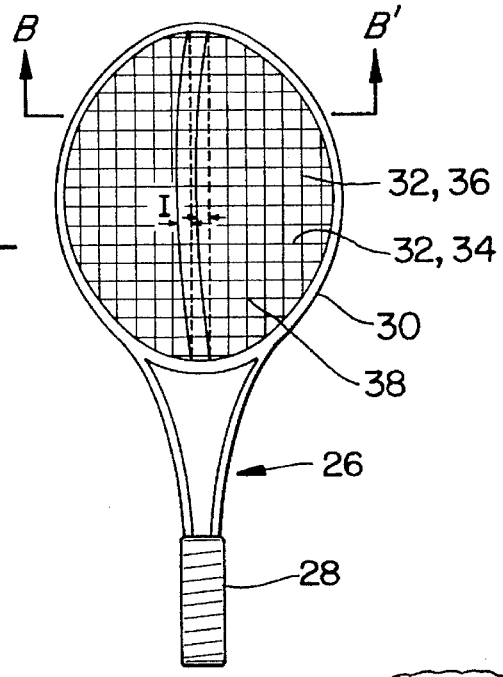
FIG. 4 is a plan view of a tennis racquet strung with lubricated, non-circular strings of the invention.

Referring to FIG. 4 a tennis racquet 26 having a handle 28, a frame 30, and lubricated, non-circular strings 32 is shown. As with the racquet 10 of FIG. 1, the strings 32 of the racquet 26 are strung so as to create a woven striking surface having horizontal and vertical strings, 34 and 36, respectively, that intersect at junctions 38. The strings 32 are placed under tension within the normal range for a tennis racquet. Two vertical strings 34 are shown displaced from their normal stable positions, shown in phantom, as a result of ball impact at point "I".

Figure 5:
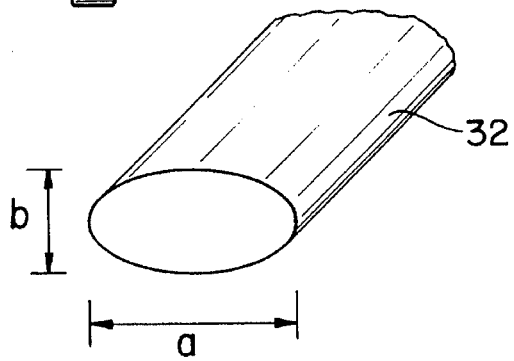
FIG. 5 is a perspective view of a string in accordance with the invention having an elliptical cross-section.
Figure 6:
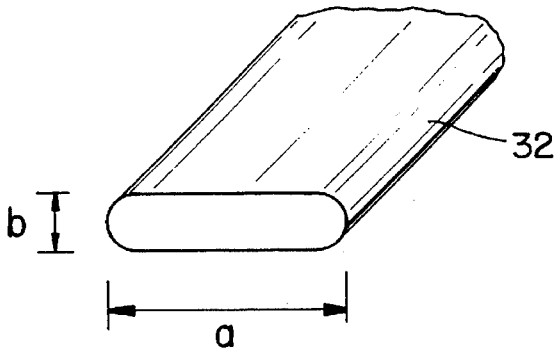
FIG. 6 is a perspective view of a string in accordance with the invention having a modified elliptical cross-section.
Figure 7:
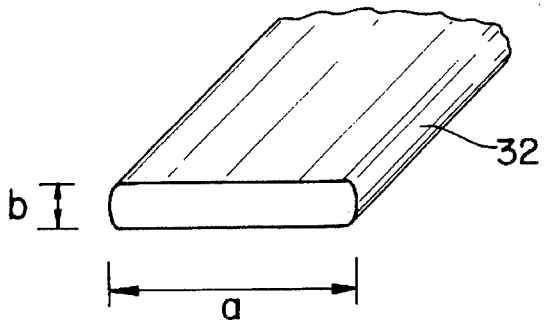
FIG. 7 is a perspective view of a string in accordance with the invention having a flat cross-section.

FIGS. 5, 6, and 7, depict various embodiments for the string 32. A distinctive feature of each of the string embodiments is their elongated or non-circular cross-section, wherein a first axis "a" is longer than a second axis "b". The elongated shape cross-section can be elliptical or oval, as shown in FIG. 5; "race-track" shaped, as illustrated in FIG. 6; flat, as depicted in FIG. 7; or any other non-circular shape.

Figure 8:
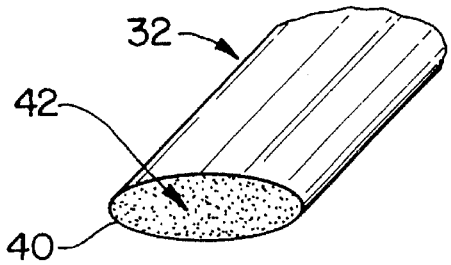
FIG. 8 is a perspective sectional view of a string having a solid lubricant dispersed in a nylon matrix.
Figure 9:
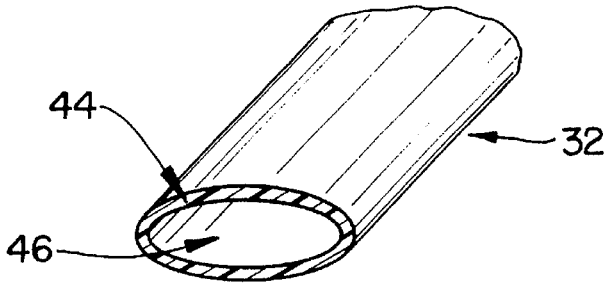
FIG. 9 is a perspective sectional view of a nylon string having a solid lubricant coating.
Figure 10:
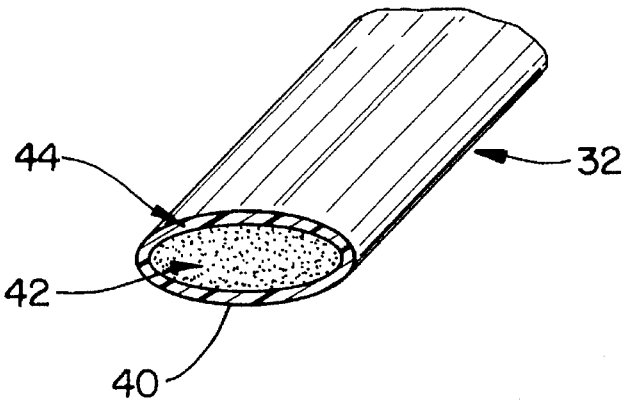
FIG. 10 is a perspective sectional view of a string having a core of solid lubricant dispersed in nylon, coated with a solid lubricant.

Referring to FIGS. 8, 9, and 10, an oval embodiment of the string 32 is shown in various configurations that incorporate a friction reducing material, such as a solid lubricant. While only an elliptically shaped string 32 is depicted in combination with the lubricant, the other non-circular shapes may be similarly treated. The lubricant provides the string surface with a coefficient of friction that is significantly lower than that of conventional gut, synthetic gut, or nylon strings in their normal untreated condition.

The lubricant can be integrated with the string 32 in several fashions to further the goal of friction reduction at the junctions 38. For example, FIG. 8 depicts an embodiment of a string 32 having a nylon matrix 40 with a solid lubricant 42 dispersed therein. FIG. 9 depicts another embodiment of the string 32 wherein a solid lubricant forms a coating 44 on a nylon string substrate 46 and FIG. 10 illustrates yet another embodiment of the string 32 wherein a solid lubricant coating 44 encases a nylon matrix 40 with a solid lubricant 42 dispersed therein. The solid lubricant 42 can be polytetrafluorethylene (Teflon®), molybdenum disulfide, graphite, or a combination of the three.

Lubricating the elongated string 32 provides several significant advantages over the prior art strings. One of the advantages is that the combination of a lubricant 42 with a non-circular string 32 encourages sliding of the vertical strings 36 on the horizontal strings 34 during and after the vertical strings 36 contact a ball, by reducing static friction at the junction 38 between the vertical and horizontal strings 36 and 34, respectively. Because the maximum value that the static friction force can achieve at the string junctions 38 is equal to the coefficient of static friction times the force normal to the strings 32 at the junctions 38, these strings 32 have greatly reduced static friction force at the string junction 38 for a given force due to the low coefficient of static friction of the solid lubricant 42 at the string surface. Additionally, the elongated shape cross-section of the string 32 reduces the normal force acting at the string junctions 38 which further reduces the static friction force.

Figure 2:
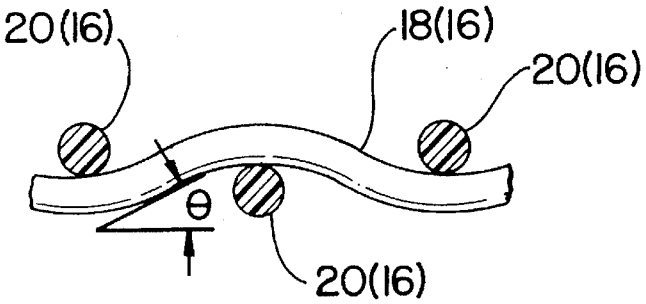
FIG. 2 (PRIOR ART)
FIG. 2 is a sectional view of strings of the racquet of FIG. 1, taken along the line A–A'.
Figure 11:
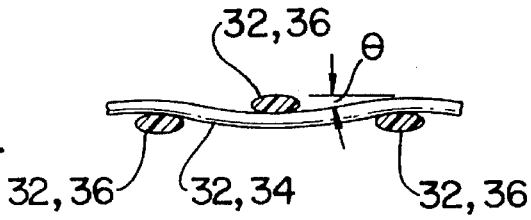
FIG. 11 is a sectional view of the racquet of FIG. 4, taken along the line B—B.

Whereas prior art racquets 10 incorporate elongated strings to inhibit string sliding, the lubricated, elongated strings 32 are configured to facilitate string sliding. FIG. 11 illustrates how the elongated shape of the strings 32 allows for the serpentine bends required for the woven pattern to be less severe than the large angular bends caused by circular strings 16 as illustrated in FIG. 2. Accordingly the angle of distortion $\Theta$ is significantly lower with elongated strings 32 than with circular strings 16. Thus, when lubricated, the strings 32 encounter less resistance to lateral movement than that encountered by the circular strings 16 which are forced to move along a more angular path. Given identical string spacing, string cross-sectional area, and string tension, lubricated non-circular strings 32 have a lower string junction normal force and thus a lower static friction.

Figure 3:
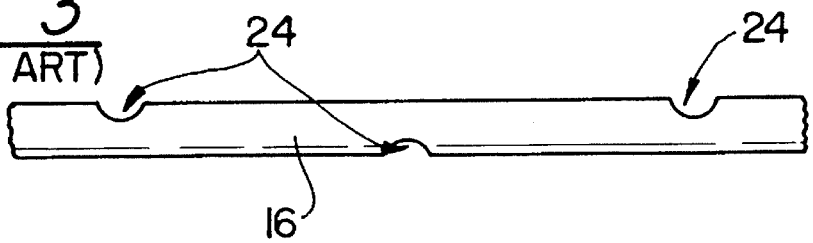
FIG. 3 (PRIOR ART)
FIG. 3 is a side elevational view of a single string of the racquet of FIG. 1.
Figure 12:
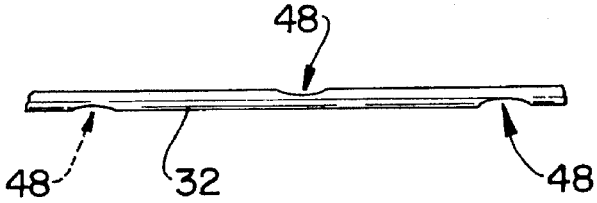
FIG. 12 is a side elevational view of one of the strings illustrated in FIG. 11.

The elongated cross-section of the intersecting strings 32 depicted in FIG. 11 also encourages string sliding by reducing the depth and by broadening the width of notches that become worn into the strings 32. FIG. 12 illustrates shallow notches 48 in the string 32. These shallow notches 48 should be compared with the deep notches 24 depicted in FIG. 3. The broader notches 48 reduce the tendency for the vertical strings 36 to bind as they slide laterally over the horizontal strings 34 during and after ball contact, resulting in greater string sliding than with conventional strings 16. This normal wear is a motivation to have lubricant 42 dispersed within the nylon matrix 40 of the string 32 so that the string's coefficient of friction does not change substantially as the surface of the string 32 is worn down.

The lubricated, non-circular strings 32 also allow greater spin to be imparted to a ball because the vertical strings 36 which are initially displaced laterally, as shown in FIG. 4, rebound towards their initial string spacing. Because the vertical strings 36 remain in contact with the tennis ball during their lateral sliding rebound phase, additional rotational momentum is imparted to the ball during the rebound.

Another advantage provided by the combination of lubricating and elongating the string 32 is that the enhanced string sliding reduces racquet vibration which increases the damping for string bed oscillations. When the strings 16 slide laterally, the kinetic friction forces present at the string junctions 22 retard the typical string oscillations normal to the plane of the string bed which are a result of the ball impact. The lateral string motions can exert retarding forces perpendicular to the plane of the string bed because of the string weave pattern. Increasing the damping for the string bed oscillations reduces vibrations that can be transmitted through the racquet frame 14 and handle 12, and into a player's arm.

Conversely, sliding vertical strings 36 cushion a lateral load by storing a portion of the energy into the vertical string lateral displacement, leaving less energy to be stored in the racquet frame 30 and thus reducing vibration of the racquet 26. This mechanism is analogous to having a racquet 10 strung at a lower tension which is known to transmit fewer vibrations because the looser strings 16 provide a greater cushion for the ball load.

Another advantage of the improved strings 32 is a more consistent ball rebound from the racquet strings 16. This is achieved by two different mechanisms. The first involves automatic retention of nearly equal string spacing in the racquet 26 due to string sliding. The second mechanism for a truer ball rebound relates to the roughness of the string bed characterized by the dimension of the string cross-section minor axis "a". Because of the elongated shape cross-section, these strings 32 allow for a smoother or flatter weave than conventional strings 16, as discussed with respect to FIG. 11. When a ball contacts the strings 32 and deforms, more uniform deformation occurs providing a more consistent ball rebound.

A further advantage of the lubricated, non-circular strings 32 is extended string life and retention of close to new string performance for a long time. FIGS. 11 and 12 illustrate how the strings 32 reduce the depth and broaden the width of the notches 48 worn into the vertical strings 36 in comparison with conventional strings 16, resulting in substantially decreased stress concentrations. String life is increased and less local string elongation occurs at the notches 48.

Although the invention has been shown and described with respect to exemplary embodiments thereof, various other embodiments may be made thereof without departing from the spirit and scope of the invention.

I claim:

1. A racquet, comprising:

a handle;

a frame secured to said handle; and a plurality of strings attached to said frame in a woven pattern, comprising a first and a second group of strings retained in said frame under tension, said first group of strings intersecting said second group of strings such that the strings in said first group alternatively underlie and overlap the strings in said alternate group to form a ball striking surface, strings of said first group contacting strings of said second group at string junctions, means for returning each of said strings to substantially its original position when displaced by impact of a striking ball, said means including each of said plurality of strings including a surface layer having a non-circular cross-section and a friction reducing material integrated with said surface layer, whereby said non-circular cross-section and said friction reducing material providing a static friction level for a given string tension at said string junctions causing a string from said first group of strings that is displaced laterally from a normal static position with respect to a string from said second group of strings to rebound toward said normal static position.

2. The string of claim 1, wherein said surface layer non-circular cross-section is oval.

3. The string of claim 1, wherein said surface layer non-circular cross-section is race-track shaped.

4. The string of claim 1, wherein said surface layer non-circular cross-section is flattened ribbon shaped.

5. The racquet of claim 1, wherein said surface layer is a matrix including said friction reducing material.

6. The racquet of claim 5, wherein said matrix has a layer of said friction reducing material as a coating thereon.

7. The racquet of claim 1, wherein said surface layer is coated with said friction reducing material.

8. The racquet of claim 1, wherein said surface layer includes nylon.

9. The racquet of claim 1, wherein said friction reducing material is a solid lubricant selected from a group consisting of polytetrafluorethylene, molybdenum disulfide, graphite, and a combination of polytetrafluorethylene, molybdenum disulfide, and graphite.

10. A method of reducing vibration in intersecting strings, comprising the steps of;

providing a first string having a surface layer including a non-circular cross-section and a friction reducing material integrated with said surface layer;

providing a second string having a surface layer including a non-circular cross-section and a friction reducing material integrated with said surface layer;

positioning said first and said second string so that they intersect at a string junction; and placing said first and said second string under tension.

* * * * *